United States Patent [19]

Koehler

[11] 4,221,205

[45] Sep. 9, 1980

[54] CIRCUIT ARRANGEMENT FOR THE CONTROL OF A STARTING OPERATION OF A DIESEL ENGINE

[75] Inventor: Rudolf Koehler, Munich, Fed. Rep. of Germany

[73] Assignee: Bayerische Motoren Werke Aktiengesellschaft, Fed. Rep. of Germany

[21] Appl. No.: 865,482

[22] Filed: Dec. 29, 1977

[30] Foreign Application Priority Data

Dec. 29, 1976 [DE] Fed. Rep. of Germany ..... 2659264

[51] Int. Cl.[2] ..... F02N 17/02

[52] U.S. Cl. ..... 123/179 H; 123/179 BG; 180/286

[58] Field of Search ..... 123/179 B, 179 BG, 179 H; 180/111, 286

[56] References Cited

U.S. PATENT DOCUMENTS

| | | | |
|---|---|---|---|
| 1,773,920 | 8/1930 | Mayforth | 123/179 BG |
| 1,828,620 | 10/1931 | Rall | 123/179 BG |
| 1,884,450 | 10/1932 | Widmann | 123/179 BG |
| 2,034,233 | 3/1936 | Hasselbaum | 180/111 |
| 2,360,227 | 10/1944 | Hemphill | 180/111 |
| 3,675,033 | 7/1972 | Richard et al. | 123/179 H |
| 3,687,215 | 8/1972 | Andres et al. | 180/111 |
| 3,691,393 | 9/1972 | Papachristou | 123/179 H |
| 3,708,683 | 1/1973 | Howland | 123/179 H |
| 3,718,128 | 2/1973 | Bother | 123/179 BG |
| 3,790,223 | 2/1974 | Fontaine | 180/111 |
| 3,793,529 | 2/1974 | Bucher | 123/179 B |

*Primary Examiner*—P. S. Lall

*Attorney, Agent, or Firm*—Craig and Antonelli

[57] ABSTRACT

A circuit arrangement for the control of the starting operation of a diesel engine in a motor vehicle, with a time-control switch determining the duration of engagement of a preliminary heating circuit which is adapted to be triggered by a drive-start-switch; the time-control switch is thereby adapted to be triggered also by an auxiliary switch independently of the drive-start-switch.

9 Claims, 2 Drawing Figures

CIRCUIT ARRANGEMENT FOR THE CONTROL OF A STARTING OPERATION OF A DIESEL ENGINE

Figure 1:
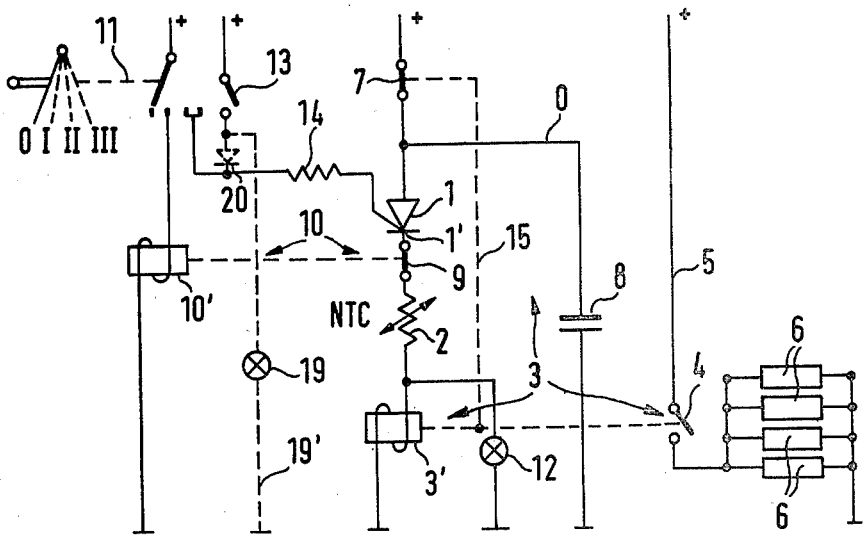

The present invention relates to a circuit arrangement for the control of the starting operation of a diesel engine in a motor vehicle, with a time-control switch determining the engagement duration of a preheating circuit, which is adapted to be triggered by a drive-start-switch.

Such a circuit arrangement is disclosed in the publication, "Motortechnische Zeitschrift 37" (1976), page 78. The time-control switch is triggered or actuated in the first, so-called drive position of the drive-start switch. Its control time is the smaller, the higher the engine temperature.

With the prior art circuit arrangement, in contrast to an Otto engine in which the engine can be started immediately without any preparatory period of time, one has to wait until the switching time (control period) of the time control switch for the preliminary heating circuit has elapsed. Only then can the diesel engine be started by an engagement of the second switching stage, i.e., of the starting position of the drive-start-switch.

The present invention is concerned with the task to provide a circuit arrangement of the aforementioned type, which enables a more rapid starting of the diesel engine without significant waiting period. The underlying problems are solved according to the present invention in that the time control switch is adapted to be triggered by an auxiliary switch independently of the drive-start-switch. The auxiliary switch makes it possible to close the preheating current circuit already prior to actuation of the drive-start-switch. This may take place, for example, already when the driver opens the vehicle door or boards the vehicle. Within the time following the boarding, during which the driver, for example, adjusts the driver seat to its correct position and engages the safety belt, the glow plugs or heater bulbs of the diesel engine are already brought to the heating temperature necessary for the starting of the engine. The driver can then actuate the drive-start-switch into the start-position and start the diesel engine.

It is advantageous therefor to arrange the auxiliary switch within the area of a boarding opening of the motor vehicle. The time-control switch is thereby actuatable already during the boarding so that the time, until the driver operates the drive-start switch, is, as a rule, at least equal to the duration of engagement of the preliminary heating circuit.

It is additionally advantageous if the auxiliary switch is positively actuated during the opening of a vehicle door. The separate actuation of the auxiliary switch is thus dispensed with for the driver. The auxiliary switch may be, for example, a door contact switch or a switch actuated automatically during the opening of the door lock.

If the auxiliary switch is selectively actuatable, then the preheating circuit will always be closed with a cold engine only when the driver seeks to start the diesel engine. An unnecessary triggering of the time-control switch is thus precluded. The auxiliary switch may be, for example, a push-button switch at the instrument panel within the area of an ingress or boarding opening. The selective actuation of the auxiliary switch may also be realized by means of a remote control, for example, with the aid of an ultrasonic transmitter.

The automatic and selective actuation of the auxiliary switch may be realized in a particularly advantageous manner with the aid of a door-lock key. An automatic actuation is coupled, for example, with the opening movement of the door-lock. For the selective actuation, a constructively simple arrangement of such an auxiliary switch resides in actuating the auxiliary switch following the opening movement for the door-lock.

Accordingly, it is an object of the present invention to provide a circuit arrangement for the control of a starting operation of a diesel engine, which avoids by simple means the aforementioned shortcomings and drawbacks encountered in the prior art.

Another object of the present invention resides in a circuit arrangement for the control of the starting operation of a diesel engine, which permits a more rapid starting of the diesel engine without significant waiting periods.

A further object of the present invention resides in a circuit arrangement for the control of the starting operation of a diesel engine which permits the energization of the preheating circuit already prior to actuation of the drive-start-switch.

Still another object of the present invention resides in a circuit arrangement which eliminates the need on the part of the driver to separately actuate an auxiliary switch or the like for energizing the heater plug or glow bulbs in diesel engines to preheat the same prior to starting the engine, when cold.

Another object of the present invention resides in a circuit arrangement of the type described above which appropriately coordinates the preheating to the time normally required for the driver to board the vehicle and be seated, ready for starting the engine.

Figure 2:
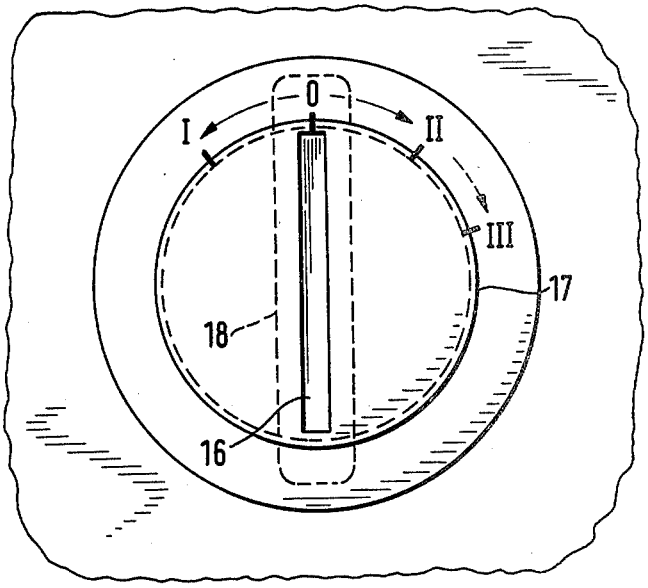

These and other objects, features and advantages of the present invention will become more apparent from the following description when taken in connection with the accompanying drawing which shows, for purposes of illustration only, one embodiment in accordance with the present invention, and wherein:

FIG. 1 is a schematic circuit arrangement for a preheating circuit of a diesel engine in accordance with the present invention which is adapted to be controlled independently of a drive-start-switch; and FIG. 2 is an elevational view of a door lock with switching positions of the door lock key for the actuation of the door lock and of a preheating circuit.

Referring now to the drawing, and more particularly to FIG. 1, the circuit arrangement according to this figure includes in a control circuit 0 for a preheating circuit of a diesel engine, a thyristor 1, an NTC-resistance 2 dependent in its value on the engine temperature and the coil 3' of a double contact relay 3, all connected in series between the positive terminal (+) and the negative terminal (−) connected with ground of the power supply of a motor vehicle. The double contact relay 3 includes a normally open contact 4 adapted to be closed upon energization of relay 3 and connected in a preheating circuit 5 between the positive terminal (+) of the power supply and the glow plugs or heater bulbs 6, indicated in FIG. 1 as resistances, of a diesel engine as well as a normally closed contact 7 operable to be opened upon energization of relay 3 and connected between the positive terminal (+) of the power supply and the thyristor 1.

A condenser 8 is connected with its one side intermediate the normally closed contact 7 and the thyristor 1, and is connected with its other side to ground. A normally closed contact 9 of a relay 10 is connected between the thyristor 1 and the resistor 2. The coil 10' of the relay 10, on the one hand, is connected to ground and on the other, is connected by way of a drive-start-switch 11 of conventional construction in the drive position I thereof to the positive terminal of the power supply. Furthermore, a control light 12 is connected intermediate the NTC-resistor 2 and the coil 3', which is also connected to ground.

The base 1' of the thyristor 1 is adapted to be connected by way of the resistance 14 with the positive terminal of the power supply means of the drive-start-switch 11 in the preheating position II thereof and in the start-position III thereof as well as by means of an auxiliary switch 13.

During the actuation of the auxiliary switch 13, the thyristor 1 fires. As a result thereof, current flows as first through the thyristor 1 by way of the normally closed contact 7, the NTC-resistor 2, the coil 3' and the control lamp 12 in parallel therewith; the control light 12 thus lights up. The coil 3' is energized and attracts its armature and thereby interrupts by means of its now opened contact 7, the current supply from the positive terminal to the thyristor 1; finally, energization of the coil 3' closes the preheating circuit 5 by closing the contact 4.

Simultaneously therewith, the condenser 8 begins to discharge so that the coil 3' continues to be supplied with current during a predetermined period of time and keeps the preheating circuit 5 closed. The duration of engagement of the preheating circuit 5 is determined by the time constant of the time control switch formed by the RC-member 15 which consists of the condenser 8, the NTC-resistor 2 and the resistance of the parallel connection of coil 3' and control light 12. It is equal to the time until the condenser 8 is discharged. This period of time is relatively long with a low engine temperature by reason of the temperature behavior of the NTC-resistance and is relatively short with a warm engine. The glow plugs or heater bulbs 6 are brought during this period of time to the necessary heating temperature which is required for the starting of the diesel engine.

If the switching time of the time-control switch has elapsed, then the thyristor 1 becomes non-conductive, and the relay 3 becomes de-energized, i.e., drops off. The normally closed contact 7 now again closes and the normally open contact 4 again opens and thereby interrupts the preheating circuit. Simultaneously therewith, the control light 12 becomes extinguished since the thyristor 1 remains non-conductive and thus indicates the end of the preheating operaton.

The preheating of the heater plugs 6 takes place as a rule prior to actuation of the drive-start-switch 11. The driver can now start the diesel engine immediately by engagement of the position III of the drive-start-switch 11 and no longer needs to wait, as customary heretofore, in the position II of the drive-start-switch 11 until the preliminary heating operation has been completed.

If with a selectively actuatable auxiliary switch 13, this actuation has been omitted, then the time control switch can also be triggered by the drive-start-switch; it is only necessary therefor to move the drive-start-switch 11 into the position II and to thereby fire the thyristor 1. The course of the preliminary heating operation is then the same as with the firing of the thyristor 1 by the auxiliary switch 13.

After a preceding preliminary heating operation which had been initiated by the auxiliary switch 13, the normally closed contact 9 prevents during the starting of the diesel engine—the drive-start-switch 11 is for that purpose in position III—the completion of a further unnecessary preliminary heating operation notwithstanding the renewed firing of the thyristor 1 since the coil 10' of the relay 10 is energized by way of the drive-start-switch 11 which is in the position I after the starting and thus interrupts the current supply to the coil 3' of the relay 3 by opening contact 9.

FIG. 2 illustrates the principle of a selective actuation of the auxiliary switch 13 with the aid of a door key. The door-lock key 18 inserted into a slot 16 of the door lock 17 has, in addition to its center position 0, a position I in which it locks the door lock 17, as well as a position II in which it unlocks the same. It can be rotated into the positions I and II, starting from the position 0.

At the end of the opening rotational movement, i.e., in the position II, a pressure point is arranged in the door lock, whereby the door key can be rotated into a position III by overcoming the pressure point. Upon overcoming the pressure point, the auxiliary switch 13 according to FIG. 1 is actuated by a mechanical coupling (not shown) and therewith the time control switch is triggered or actuated in the manner described hereinabove.

In addition to a selective actuation of the auxiliary switch 13 in FIG. 1, also an automatic actuation is possible. For that purpose, the auxiliary switch 13 is, for example, a door-contact-switch which controls an interior light 19 that is connected in a circuit 19' indicated in dash lines. A diode 20 thereby prevents the turning-on of the interior light 19 by the drive-start switch 11 in the positions II and III thereof.

The present invention illustrates a simple possibility to eliminate with the diesel engine by simple means the prior art disadvantage of a lengthy starting operation.

While I have shown and described only one embodiment in accordance with the present invention, it is understood that the same is not limited thereto but is susceptible of numerous changes and modifications as known to those skilled in the art, and I therefore do not wish to be limited to the details shown and described herein but intend to cover all such changes and modifications as are encompassed by the scope of the appended claims.

I claim:

1. A circuit arrangement for the control of the starting operation of a diesel engine in a motor vehicle, comprising time-control switch means determining the duration of engagement of a preheating circuit means, said time-control switch means being operable to be triggered by a drive-start-switch means, characterized in that the timing switch means is triggered by an auxiliary switch means independently of the drive-start-switch means.

2. A circuit arrangement according to claim 1, characterized in that the time-control switch means includes an RC-member.

3. A circuit arrangement according to claim 1, characterized in that the auxiliary switch means is arranged within the area of a boarding opening of the motor vehicle.

4. A circuit arrangement according to claim 3, characterized in that the auxiliary switch means is mechanically actuated during opening of a vehicle door.

5. A circuit arrangement according to claim 3, characterized in that the auxiliary switch means is selectively actuatable.

6. A circuit arrangement according to claim 5, characterized in that the auxiliary switch means is actuatable with the aid of a door-lock key in conjunction with a door lock means.

7. A circuit arrangement according to claim 6, characterized in that the actuation of the auxiliary switch means by means of the door-lock key takes place following the opening movement of the door-lock means.

8. A circuit arrangement according to claim 4, characterized in that the auxiliary switch means is actuatable with the aid of a door-lock key in conjunction with a door-lock means.

9. A circuit arrangement according to claim 8, characterized in that the actuation of the auxiliary switch means by means of the door-lock key takes place following the opening movement of the door-lock means.

* * * * *